United States Patent [19]

Stinson

[11] Patent Number: 4,767,098

[45] Date of Patent: Aug. 30, 1988

[54] CONTAINER LIFT ASSEMBLY

[75] Inventor: Douglas W. Stinson, South Langley, Canada

[73] Assignee: Stinson Containermate Mfg. Inc., Delta, Canada

[21] Appl. No.: 35,029

[22] Filed: Apr. 6, 1987

[51] Int. Cl.[4] ..... B66F 7/26

[52] U.S. Cl. ..... 254/45; 254/89 R; 294/81.1; 294/81.5

[58] Field of Search ..... 254/45–50, 254/89 R, 4 R, 324, 387; 414/458–461, 391, 399; 294/81.1, 81.5, 81.56, 68.3; 248/163.1

[56] References Cited

U.S. PATENT DOCUMENTS

| | | | |
|---|---|---|---|
| 634,404 | 10/1899 | Drinkwater | 254/45 |
| 2,069,236 | 2/1937 | Fitch | 414/391 |
| 2,533,999 | 12/1950 | Colley | 254/324 |
| 2,643,856 | 6/1953 | Sales | 254/45 |
| 3,135,407 | 6/1964 | Back | 254/45 |
| 3,161,309 | 12/1964 | Baudhuin et al. | 414/459 |
| 3,744,652 | 7/1973 | Rieschel | 414/459 |
| 3,749,363 | 7/1973 | Hauser | 254/45 |
| 4,549,842 | 10/1985 | Tidmarsh | 414/391 |
| 4,697,603 | 10/1987 | Steinhauer et al. | 131/84.4 |

*Primary Examiner*—Frederick R. Schmidt

*Assistant Examiner*—Judy J. Hartman

*Attorney, Agent, or Firm*—Bull, Housser & Tupper

[57] ABSTRACT

The invention relates to a lift assembly for handling a heavy goods container such as used in marine cargo and highway transportation. The lift assembly includes two right hand sub-assemblies and two left hand sub-assemblies, which, when connected together, form an open space frame adapted to receive the container. Quick release connectors are provided for hingedly connecting the sub-assemblies together. There are links, connected to the sub-assemblies and adapted to cooperate with the container, for supporting the container above the ground. The lift assembly includes lifters for raising and lowering each right hand and left hand sub-assembly, thereby raising and lowering the container as required. By differentially adjusting the lifters, the container may be moved (swayed) sideways and fore and aft to position or romove accurately the container on or off a transportation vehicle. The lift assembly also includes locators for locating the container relative to the lift assembly, which concurrently stablizes the lift assembly against swaying. Preferably, the lift assembly includes weight monitors, connected to the lifters, for monitoring the weight of the container.

23 Claims, 5 Drawing Sheets

CONTAINER LIFT ASSEMBLY

BACKGROUND OF THE INVENTION

This invention relates to devices used for the raising and lowering of heavy cargo containers from transportation vehicles such as semi-trailers.

These devices are useful because they allow the same cargo container to be transported by different vehicles. These devices can also be used to remove a cargo container from a container transportation vehicle so that the contents of the cargo container can be loaded efficiently; the tractor of the vehicle does not have to stand idle during the loading or unloading process.

Massive and expensive cranes have been developed for loading and unloading containers from various types of transportation vehicles. These cranes are usually permanently mounted on a foundation and cannot therefore be easily transported to another site.

Accordingly, there is a need for a container handling assembly which is relatively inexpensive to manufacture, and can also be portable.

U.S. Pat. No. 2,069,236 (Fitch) relates to a mechanism for raising and supporting demountable bodies. Fitch discloses a plurality of individual jacks which are mounted at each corner of a container and, through linkage mechanisms, are used to raise the corners of the container. U.S. Pat. No. 3,749,363 (Hauser) relates to jacks for use with containerized cargoes. Hauser discloses the use of individual mobile jacks which can be installed at each corner of a container and, when extended, the container can be lifted.

Other patents of general interest are U.S. Pat. Nos. 4,549,842 (Tidmarsh), 2,643,856 (Sales) and 634,404 (Drinkwater). While some prior art devices are relatively light weight and portable, they can be relatively unstable when handling heavy containers. In addition, none of the prior art devices appear to disclose the use of weight monitoring devices to monitor the weight of the container being handled.

SUMMARY OF THE INVENTION

The invention reduces the difficulties and disadvantages of the prior art by providing a lift assembly which is relatively light-weight, portable and which is relatively stable when handling a heavy container and which includes a weight monitoring device to monitor the weight of the container being handled.

The invention relates to a lift assembly, having a first end and a second end, for handling a container. The lift assembly includes two right hand sub-assemblies and two left hand sub-assemblies, which, when connected together, form an open space adapted to receive the container. Connection means are provided for hingedly connecting the sub-assemblies together. The lift assembly includes link means, connected to the sub-assemblies and adapted to cooperate with the container, for supporting the container above the ground. In addition, the lift assembly includes lift means, cooperating with the sub-assemblies, for raising and lowering each right hand and left hand sub-assembly, thereby raising and lowering the container as required. By differentially adjusting the lift means, the container may be moved (swayed) sideways and fore and aft to position or remove accurately the container on or off a transportation vehicle.

The lift assembly is arranged so that there is a right hand and a left hand sub-assembly adjacent the first end and a right hand and a left hand sub-assembly adjacent the second end.

The right sub-assembly includes a vertical post, a horizontal transverse member and a horizontal longitudinal member, each having respective inner and outer ends, all of which intersect at their respective inner ends mutually perpendicularly to form a rigid corner. The connection means are located at the outer ends of each of the horizontal longitudinal members of the right hand sub-assembly and at the outer ends of each of the horizontal transverse members of the right hand sub-assembly.

Each left hand sub-assembly is a mirror image of the right hand sub-assembly about a first plane passing through the quick release connection means located at the outer ends of the horizontal transverse members, the first plane being parallel to a second plane which passes through the vertical post and the horizontal longitudinal member.

Additionally, the lift assembly includes strengthening means for strengthening the right hand and left hand sub-assemblies. The strengthening means includes a top diagonal brace and a side diagonal brace, the top diagonal brace being connected adjacent the outer end of the horizontal longitudinal member and adjacent the outer end of the horizontal transverse member. The diagonal brace is connected adjacent the outer end of the horizontal longitudinal member and adjacent the outer end of the vertical post.

Preferably, the lift means includes an extendible and retractable actuator which is connected adjacent the outer end of the vertical post.

Preferably, the link means includes a plurality of elongated members, each having a first end and a second end, the elongated members being connected at the first ends thereof to locations adjacent inner ends (which are the upper ends) of the vertical posts. The elongated members have connection means at the second ends for connecting to the container.

Usefully, the lift assembly includes a cross strut, having two ends, which is positioned transversely between the first and second ends of the lift assembly, the cross strut being connected adjacent the outer ends of the horizontal longitudinal members.

The link means further includes at least two elongated members each having a first end and a second end, the elongated members being connected at the first ends to the cross strut adjacent the ends thereof.

Advantageously, the lift assembly includes weight monitoring means, cooperating with the vertical posts, for monitoring the load carried by the vertical posts. The lift means includes a fluid actuator and the weight monitoring means includes a pressure transducer, exposed to fluid pressure within each actuator, and means for translating the output of the transducer into a total weight for the container.

The connection means are quick release connection means which include first and second portions and a pin, the portions having holes therein adapted to be mutually aligned so that the pin can pass through the holes in the portions in a horizontal manner to provide a horizontal axis of rotation between adjacent sub-assemblies, thereby permitting one or more of the sub-assemblies to be raised above the others as required. The lift assembly preferably includes means for locating the container relative to the lift assembly.

DESCRIPTION OF THE PREFERRED EMBODIMENT

Figure 1:
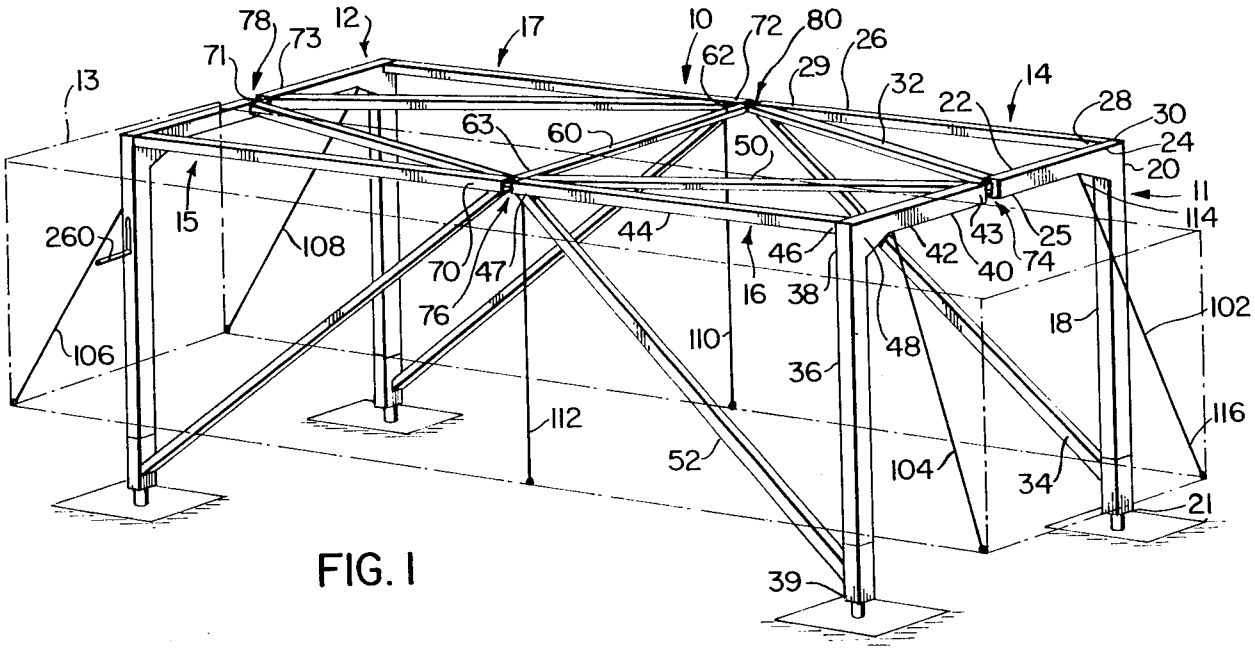
FIG. 1 is a perspective of the container lift assembly according to the invention showing the assembly in a lowered position and, showing a container in broken lines position.
Figure 2:
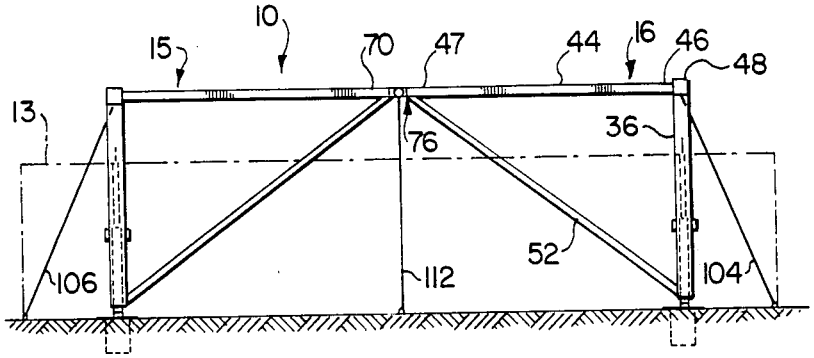
FIG. 2 is a side view of the container lift assembly of FIG. 1, showing the container in broken lines.

Referring to FIGS. 1–4, the lift assembly is generally designated as 10. The lift assembly 10, has a first end 11 and a second end 12. The lift assembly 10 includes two right hand sub-assemblies 14 and 15, and two left hand sub-assemblies 16 and 17. The right hand sub-assembly 14, and the left hand sub-assembly 16 are adjacent the first end 11 and the right hand sub-assembly 15 and the left hand sub-assembly 17 are adjacent the second end 12. A heavy goods container 13, as carried on semi-trailers, is shown in broken lines only in FIGS. 1 and 4, supported above the ground by a plurality of flexible elongated members or cables 102, 104, 106, 108, 110 and 112. The container 13 is a standard forty foot container.

The right hand sub-assembly 14 includes a vertical post 18, which has an inner end 20 and an outer end 21, a horizontal transverse member 22, which has an inner end 24 and an outer end 25, and a horizontal longitudinal member 26, which has an inner end 28 and an outer end 29. The vertical post 18, the horizontal transverse member 22 and the horizontal longitudinal member 26 all intersect at their respective inner ends 20, 24 and 28 mutually perpendicularly to form a rigid corner 30.

Right hand sub-assembly 14 also includes strengthening means for strengthening the sub-assembly. The strengthening means includes a top diagonal brace 32 and a side diagonal brace 34. The brace 32 is connected adjacent the outer ends 25 and 29. The brace 34 is connected adjacent the outer ends 21 and 29.

The right hand sub-assembly 15 is similar in structure to the right hand sub-assembly 14.

The left hand sub-assembly 16 is a mirror image of the right hand sub-assembly 14 about a first vertical plane 31 passing through the outer end 25, the first vertical plane being parallel to a second vertical plane passing through the vertical post 18 and the horizontal longitudinal member 26. The left hand sub-assembly 16 includes a vertical post 36, which has an inner end 38 and an outer end 39, a horizontal transverse member 40, which has an inner end 42 and an outer end 43 and a horizontal longitudinal member 44, which has an inner end 46 and an outer end 47. Inner ends 38, 42 and 46 all intersect mutually perpendicularly to form a rigid corner 48.

The left hand sub-assembly 16 also includes strengthening means which includes a top diagonal brace 50 and a side diagonal brace 52. The brace 50 is connected adjacent the outer ends 43 and 47 and the brace 52 is connected adjacent the outer ends 39 and 47.

The left hand sub-assembly 17 is a mirror image of the left hand sub-assembly 16 about the first vertical plane.

The lift assembly 10 also includes a cross strut 60, having a first end 62 and a second end 63, the strut being positioned transversely between the first end 11 and the second end 12, and also being connected adjacent the outer ends 29 and 47.

For ease of convenience, the outer end of the horizontal longitudinal member of the right hand sub-assembly 15 will be designated 70. The outer end of the horizontal transverse member of the right hand sub-assembly 15 will be designated 71. The outer end of the horizontal longitudinal member of the left hand sub-assembly 17 will be designated 72. The outer end of the horizontal transverse member of the left hand sub-assembly 17 will be designated 73.

QUICK RELEASE CONNECTION MEANS

The lift assembly 10 includes quick release connection means for hingedly connecting together the sub-assemblies 14, 15, 16 & 17.

Figure 3:
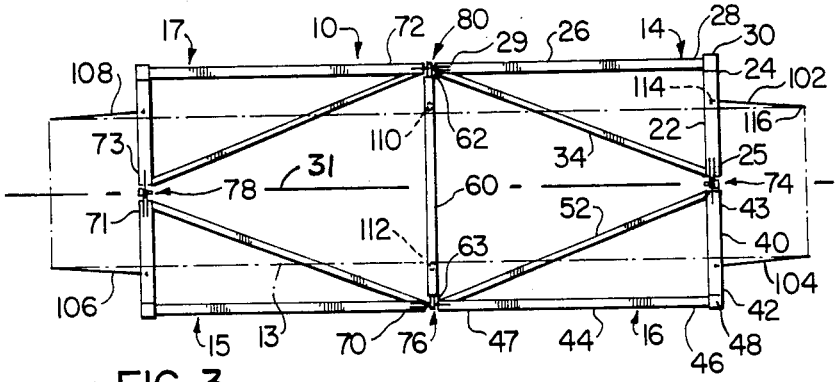
FIG. 3 is a top view of the container lift assembly of FIG. 1, showing the container in broken lines.

The quick release connection means 74, 76, 78 & 80 are located adjacent the outer ends 25 and 43, the outer ends and 70, the outer ends 71 and 73, and the outer ends 29 and 72, respectively (as best shown in FIGS. 1 and 3).

The structure of the quick release connection means 74 will now be described. It must be understood that the structure of the quick release connection means 78 is similar to that of the quick release connection means 74.

Figure 10:
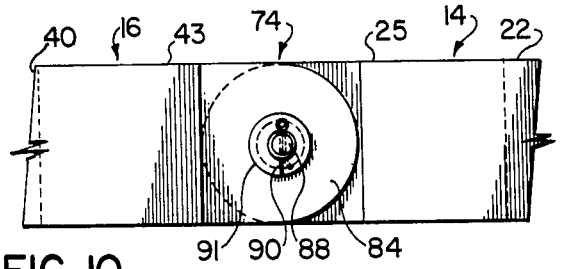
FIG. 10 is an enlarged end view of a quick release connection means, taken in the same direction as FIG. 4, showing the end of a fastener.
Figure 11:
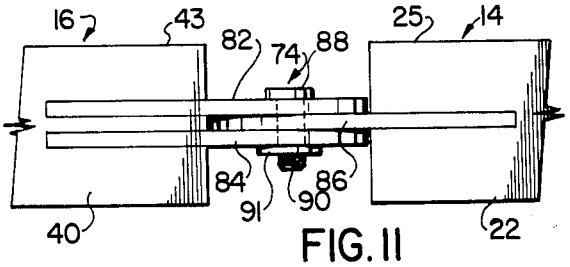
FIG. 11 is a top view of the quick release connection means of FIG. 10.

Referring to FIGS. 10 and 11, the quick release connection means 74 includes a pair of spaced apart first finger portions 82 and 84 which extend outwardly from the outer end 43, a second finger portion 86 which extends outwardly from the outer end 25, and a fastener 88. The second finger portion 86 is receivable within the space between the pair of first finger portions 82 and 84. Each of the finger portions 82, 84 and 86 have respective holes therein which are alignable when the second finger portion 86 is received within the space between the pair of first finger portions 82 and 84. The fastener 88 can pass through the aligned holes in the finger portions 82, 84 and 86 in a horizontal manner to provide a horizontal axis of rotation between sub-assemblies 14 and 16. The fastener 88 has a hole therein so that a pin 90 can be passed therethrough to lock the fastener 88 in place, a washer 91 being interposed between the pin 90 and the finger 84.

It is to be understood that the pair of first finger portions 82 and 84 could extend from the outer end 25 and the second finger portion 86 could extend from the outer end 43. It is, however, important that the pair of first finger portions 82 and 84 and the second finger portion 86 extend from their respective outer ends so that the fastener 88 passes through the holes in the portions 82, 84 and 86 in a horizontal manner to provide a horizontal axis of rotation between sub-assemblies 14 and 16, thereby permitting one or more of the sub-assemblies to be raised or lowered relative to the others as required.

The structure of the quick release connection means 76 will now be described. It must be understood that the structure of the quick release connection means 80 is similar to that of the quick release connection means 76.

Figure 12:
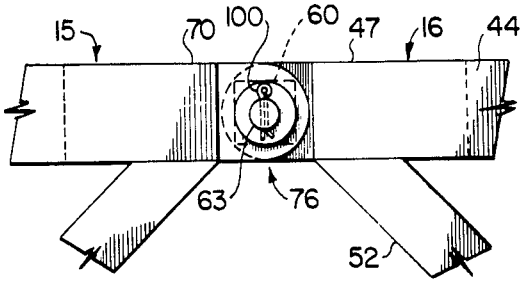
FIG. 12 is an enlarged end view of a quick release connection means, taken in the same direction as FIG. 2, showing one end of a cross strut.
Figure 13:
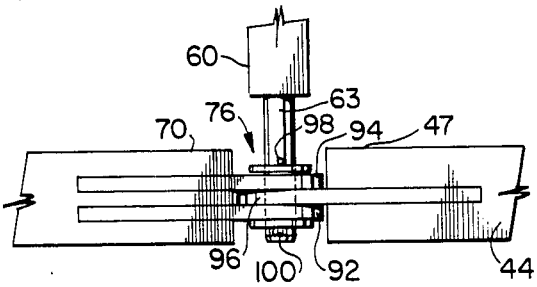
FIG. 13 is a top view of the quick release connection means of FIG. 12.

Referring to FIGS. 12 and 13, the quick release connection means 76 includes a pair of spaced apart first finger portions 92 and 94 which extend from the outer end 70, a second finger portion 90 which extends from the outer end 47 and the second end 63.

The second finger portion 96 is receivable within the space between the pair of portions 92 and 94. Each of the finger portions 92, 94 and 96 have holes therein which are alignable when the portion 96 is received within the space between the pair of portions 92 and 94. The second end 63 can pass through the holes in the portions 92, 94 and 96 in a horizontal manner to provide a horizontal axis of rotation, thereby permitting one of the sub-assemblies to be raised above the others as required. The second end 63 of the cross strut 68 has two holes therein (as best shown in FIG. 13) so that pins 98 and 100 can be passed therethrough to lock the second end 63 in place.

It is to be understood that the portions 92 and 94 could extend from the outer end 47 and the portion 96 could extend from the outer end 78.

LINK MEANS

The lift assembly 10 also includes link means, connected to the sub-assemblies 14, 15, 16 and 17 and adapted to cooperate with the container 13, for supporting the container 13 above a surface, such as the ground. The link means includes six elongated members 102, 104, 106, 108, 110 and 112 (as best shown in FIG. 1), each elongated member being a length of flexible cable and having respective inner and outer ends, such as an inner end 114 and an outer end 116 of the elongated member 102. Each of the elongated members have connection means adjacent their respective outer ends for connecting to the container 13. Each of the elongated members 102, 104, 106 and 108 are connected at their respective inner ends adjacent the inner ends of the horizontal transverse member of each sub-assembly 14, 15, 16 and 17. Elongated members 110 and 112 are connected at their respective inner ends to cross strut 60 adjacent the first end 62 and the second end 63.

Figure 7:
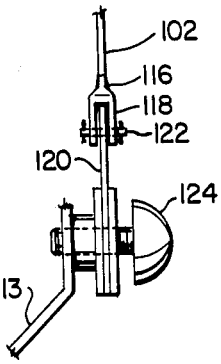
FIG. 7 is a simplified, fragmented side view of an elongated member and a connection means for connecting the elongated member to the container.

FIG. 7 shows a typical elongated member such as member 102. FIG. 7 also shows the connection means which are used to connect the container 13 to the members 102, 104, 106, 108, 110 and 112.

The connection means includes a clevis 118, located adjacent the outer end 116, a plate 128, a pin 122 and a bolt 124. The clevis 118 has two holes therein which are mutually alignable with a hole in the upper end of the plate 120 so that the pin 122 can pass through the holes in the clevis and the plate. The lower end of the plate 120 has a hole therein which is mutually alignable with a standard receptacle located on most containers. The bolt 124 can pass through the hole in the lower end of the plate and the receptacle in the container 13. Similar connections means are located adjacent the outer ends of the members 104, 106, 108, 110 and 112 so that the container 13 can be quickly connected or disconnected at six locations to the lift assembly 10. To handle a standard twenty foot container, only members 102, 104, 106 and 108 are required, thus eliminating the use of the members 110 and 112.

LIFT MEANS

The lift assembly 10 includes lift means, cooperating with the sub-assemblies, for raising and lowering each sub-assembly, thereby raising and lowering the container 13 as required. The lift means cooperates with the vertical post of each sub-assembly, and is mounted on a foundation support positioned on the ground.

The structure of the vertical post 18 of the sub-assembly 14 will now be described. It must be understood that there are three other vertical post each identical in structure to that of the vertical post 18.

Figure 5:
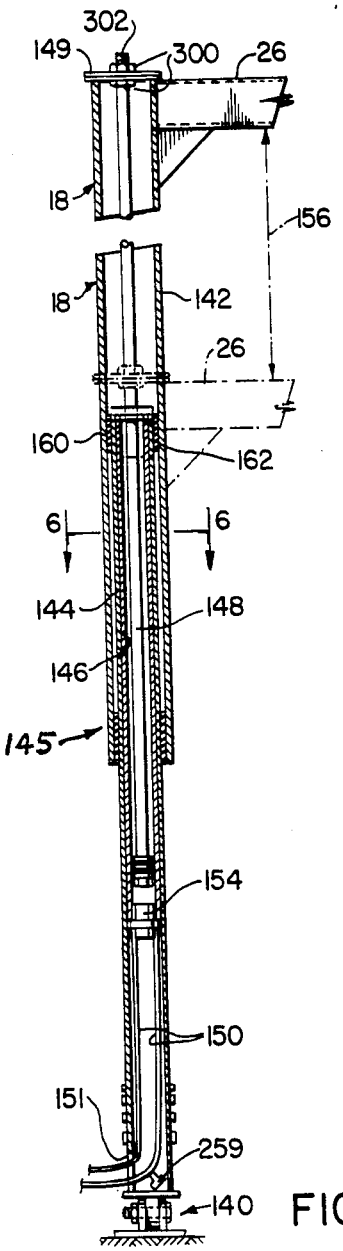
FIG. 5 is a simplified, fragmented, longitudinal section of a vertical post of the container lift assembly of FIG. 1, some portions not shown in section, showing the vertical post in a raised position in full lines and a fragmented lowered position in broken lines.
Figure 5A:
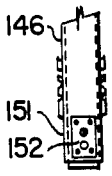
FIG. 5*a* is a simplified, fragmented right side view of the vertical post of FIG. 5 showing the cover plate access.

Referring to FIG. 5, there is shown the vertical post 18 which is mounted on a foundation support generally designated as 140. The vertical post 18 includes a hollow outer post 142 having a square cross-section, a hollow inner post 144 having a square cross-section, and a hydraulic cylinder assembly 145, which serves as the actuator. The assembly 145 includes a hydraulic cylinder body 146 and a cylinder ram 148. The cylinder ram 148 is connected to the outer post 142 by means of an annular flange 149 and nuts 300, the nuts being engagable with a threaded portion 302 on a top end of the ram 148.

A pair of flexible hydraulic hoses 150 is connected to the cylinder body 146 and a lower portion 151 of the inner post 146. A cover plate access 152 is connected to the lower portion 151. The access 152 is used to connect a conventional hydraulic power pack (not shown) to the hoses 150, so that the vertical post 18 can be raised and lowered as required. The power pack includes a flow divider and control valves so that the vertical posts of each sub-assembly can be raised or lowered together, or separately if required. A holding valve 154 is disposed at the bottom of the cylinder body 146 and acts to maintain the vertical post 18 in the raised position if there is a failure in the hydraulic power pack.

In FIG. 5, the member 26 is shown in raised and lowered positions in full and broken lines respectively. A spacing 156 between the raised and lowered positions of the member 26 shows the stroke of the cylinder ram 148.

Figure 6:
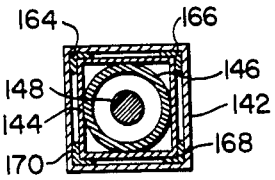
FIG. 6 is a sectional view taken along line 6—6 of FIG. 5.

The vertical post 18 also includes a plurality of guide blocks which are Ultra High Molecular Weight Polyethylene (UHMW-PE) pads in this embodiment. There are four upper guide blocks located adjacent the top end of the inner post 144, the guide blocks being generally L-shaped and equally spaced around the inner post 144 at the corners thereof. Two guide blocks 160 and 162 are shown in FIG. 5. There are also four lower guide blocks 164, 166, 168 and 170 located adjacent the bottom end of the outer post 142, as shown in FIG. 6. The lower guide blocks are also generally L-shaped and equally spaced around the inner post 144 at the corners thereof. The guide blocks are connected to the inner post by suitable means. The function of the guide blocks is to reduce sliding friction, relative lateral movement and possible binding between the inner post 144 and the outer post 142.

Figure 8:
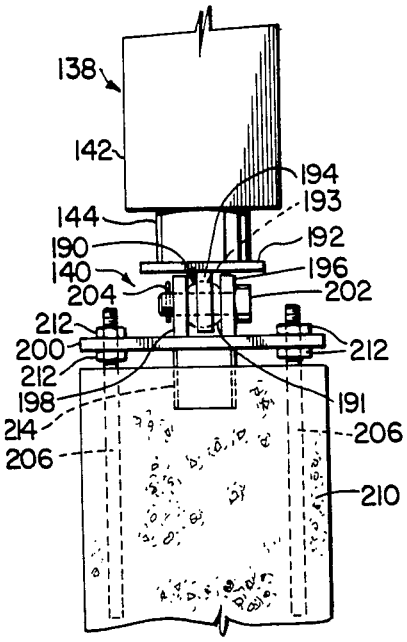
FIG. 8 is a simplified, enlarged, fragmented end view showing a lower portion of the vertical post of FIG. 5 connected to a foundation support.
Figure 9:
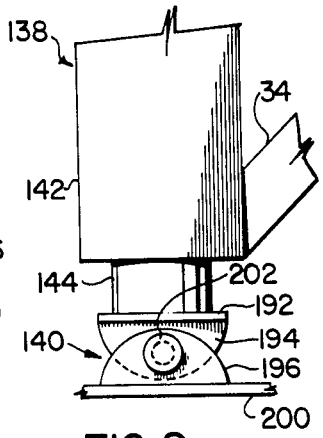
FIG. 9 is a simplified, enlarged, fragmented side view of the vertical post of FIG. 8.

As shown in FIGS. 8 and 9, the vertical post 18 is mounted on a foundation support 140. Each sub-assembly has a vertical post 18 mounted on a foundation support similar in structure to the foundation support 140 so that the lift assembly can be mounted in a semi-permanent manner to the ground.

The vertical post 18 is mounted on a spherical bearing assembly 190 to provide limited rotational movement of the vertical post 18 about the lower end. A square horizontal first plate 192 is connected adjacent the bottom end of the inner post 144. The bearing assembly 190 has male and female portions 191 and 193 with complementary male and female partially spherical surfaces. A bracket 194 extends downwardly from the centre of the plate 192. The female portion is connected to the bracket 194 and the male portion is connected to a bolt 202. A pair of brackets 196 and 198 extend upwardly from a square horizontal second plate 200, which is larger than the first plate 192. The brackets 196 and 198 do not contact the plate 192 and the bracket 194 does not contact the plate 200. The spherical bearing assembly 190 is disposed between the pair of brackets 196 and 190. The male spherical portion and the pair of brackets 196 and 198 have horizontal holes therein which are mutually alignable for the passage therethrough of the bolt 202. The bolt 202 has a hole in one end for the passage therethrough of a locking pin 204 to lock the bolt 202 in place.

The second plate 200 has a four holes therein to receive four threaded rods 206 disposed adjacent corners of the corners of the plate 200. The threaded rods 206 are partially embedded within a concrete footing 210. Each threaded rod 206 has a levelling nut 212 above and below the plate 200 so that the plate 200 can be levelled. An I-beam 214 is located beneath the spherical bearing assembly 190 and is partially embedded within the concrete footing 210. The I-beam 214 serves to support the plate 200, to keep the same from bending and to transmit horizontal forces from the vertical post 18 to the concrete footing 210.

WEIGHT MONITORING MEANS

The lift assembly 10 also includes weight monitoring means, connected to the lift means, for monitoring the weight of the container 13. The weight monitoring means includes a pressure transducer 259 which is exposed to fluid pressure within each vertical post and means for translating the transducer readings of each post into a total weight for the container. By monitoring the load on each of the vertical posts during loading, the container can be filled so that the weight of the contents can be distributed generally evenly. In FIG. 1, an outlet 260 is operatively connected to the pressure transducers, by means not shown, and is operatively connectable to the translation means.

LOCATING MEANS

The lift assembly 10 also includes means for locating the container 13 relative to the lift assembly 10 to reduce or eliminate transverse swaying of the lift assembly 10 when handling a container.

Figure 4:
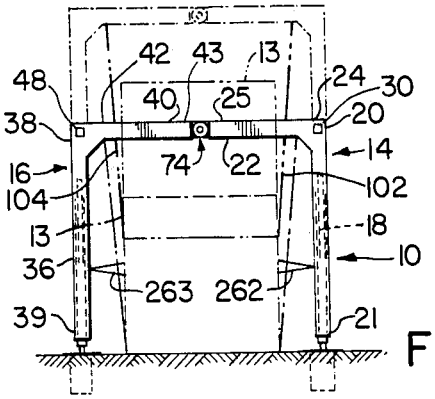
FIG. 4 is an end view of the container lift assembly of FIG. 1, showing the container in broken lines in lowered and raised positions, and also showing the lift assembly in the raised position in broken lines.

The means for locating the container relative to the lift assembly 10 includes a locating member connected to each vertical post. The structure and operation of a locating member 262 which is connected to the vertical post 18 will now be described, although it must be understood that the structure and operation of the other locating members is identical to that of the locating member 262. FIG. 4 shows a locating member 263 connected to the vertical post 36.

Figure 14:
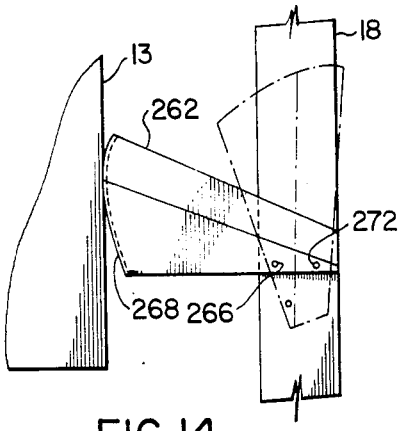
FIG. 14 is a side view of a locating member in an active position and also shown in an inactive position in broken lines.
Figure 15:
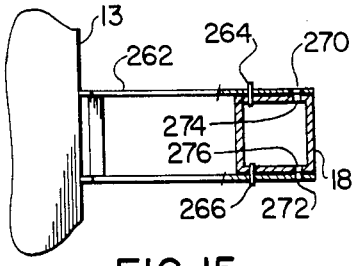
FIG. 15 is a top view of the locating member of FIG. 14 in the active position.

With reference to FIGS. 4, 14 and 15, the locating member 262 is journalled for rotation relative to the vertical post 18 by aligned pins 264 and 266 so that the member 262 can move between an active position (shown in solid lines in FIG. 14 and also shown in FIGS. 4 and 15) and an inactive position (shown in broken lines in FIG. 14). The locating member 262 has an eccentric cam surface 268 which engages the side of the container 13 when the member 262 is in the active position to prevent lateral movement of the container 13. The cam surface accommodates variations in spacing between the vertical posts and accommodates wear and damage in the sides of the container. Accordingly, the cam surface needs adequate eccentricity to accommodate the variables. The locating members are necessary to provide a good interference fit between the locating members and the container to locate the container between the vertical posts and to reduce sway of the lift assembly. The member 262 also has two holes 270 and 272 therein which are mutually alignable with holes 274 and 276 in the vertical post 18 to receive a pair of locking pins, (not shown) thereby locking the member 262 in the active position. When the locating members are in contact with the container, the latter serves to stiffen the lift assembly, and thus the locating members concurrently stablize the lift assembly against swaying.

OPERATION

In operation, an operator backs a transportation vehicle hauling the container 13 so that the container 13 is within or substantially within the lift assembly 10 (depending on the size of the container 13). The operator then connects the container 13 to the lift assembly 10 with the connection means which are located adjacent the outer ends of each of the six elongated flexible members, the elongated members being slack at this time. The operator then switches on the hydraulic power pack to the "raise" position, which supplies pressurized hydraulic fluid through each of the hydraulic hoses to each vertical post which extends the respective rams simultaneously and equally, thus tightening the elongated flexible members and raising the container above the transportation vehicle.

If need be, the sub-assemblies 14 and 16 can be raised above or lowered below the sub-assemblies 15 and 17. Similarly, the sub-assemblies 15 and 16 can be moved independently of the sub-assemblies 14 and 17. These independent movements are accomplished by employing the control valves. These independent movements may be necessary if the lift assembly 10 is located on an inclined surface, and are permitted by the "hinging effect" of the quick-release connection means between the sub-assemblies. Once the container 13 is raised above the transportation vehicle, the vehicle can be driven away.

The container 13 is then lowered to the ground for emptying, or can be held in an elevated position until another transportation vehicle is backed into the the lift assembly 10. The hydraulic power pack is then switched on to the "lower" position to lower the container 13 onto the transportation vehicle.

It is to be understood that the invention is not confined to the particular construction and arrangement of parts as herein illustrated and described, but embraces all such modified forms thereof as come within the scope of the following claims.

What is claimed is:

1. A lift assembly, having a first end and a second end, for handling a container comprising:

(a) a plurality of sub-assemblies, which when connected together, form an open space frame adapted to receive the container wherein each sub-assembly includes a vertical post and a plurality of horizontal members, said post and members each having respective inner and outer ends, all of which intersect at their inner ends to form a rigid corner;

(b) connection means located at the outer ends of each of the horizontal members for hingedly connecting the sub-assemblies together;

(c) link means, connected to the sub-assemblies and adapted to cooperate with the container, for supporting the container above the ground; and (d) lift means, cooperating with the sub-assemblies, for raising and lowering each sub-assembly, thereby permitting one or more of the sub-assemblies to be raised above the other, thus raising and lowering the container as required.

2. A lift assembly as claimed in claim 1, wherein there is a right hand and a left hand sub-assembly adjacent the first end of the lift assembly, and a right hand and a left hand sub-assembly adjacent the second end of the lift assembly.

3. A lift assembly as claimed in claim 2, wherein the right hand sub-assembly includes a vertical post, a horizontal transverse member and a horizontal longitudinal member, each having respective inner and outer ends, all of which intersect at their respective inner ends mutually perpendicularly to form a rigid corner.

4. A lift assembly as claimed in claim 3, wherein the connection means are located at the outer end of each of the horizontal longitudinal members and at the outer end of each of the horizontal transverse members.

5. A lift assembly as claimed in claim 4, wherein the connection means includes:

(a) a pair of spaced apart first connection members, each with holes therein;

(b) a second connection member also having a hole therein which is alignable with the holes in the first connection members, said second connection member being receivable within the space between the first connection members; and (c) a pin which can pass through the aligned holes in the connection members to connect the connection members together.

6. A lift assembly as claimed in claim 4, wherein the left hand sub-assembly is a mirror image of the right hand sub-assembly about a first plane passing through the connection means located at the outer ends of the horizontal transverse members, said first plane being parallel to a second plane passing through the vertical post and the horizontal longitudinal member of the right hand sub-assembly.

7. A lift assembly as claimed in claim 3, further including strengthening means for strengthening the right hand and left hand sub-assemblies.

8. A lift assembly as claimed in claim 7 wherein the strengthening means includes a top diagonal brace and a side diagonal brace, said top diagonal brace being connected adjacent the outer end of the horizontal longitudinal member and adjacent the outer end of the horizontal transverse member, and said side diagonal brace being connected adjacent the outer end of the horizontal longitudinal member and adjacent the outer end of the vertical post.

9. A lift assembly as claimed in claim 1, wherein (a) each sub-assembly includes a vertical post; and (b) the lift means includes an extendible and retractable actuator which is located within each vertical post.

10. A lift assembly as claimed in claim 9, further including an inner post, located within the vertical post and mounted for guided axial movement relative thereto, and wherein the actuator is a hydraulic cylinder assembly having a cylinder body and a cylinder cam.

11. A lift assembly as claimed in claim 10, wherein the inner post is mounted on a bearing assembly to support the lift assembly on the ground and to permit limited rotational movement of the vertical post about two mutually perpendicular horizontal axes.

12. A lift assembly as claimed in claim 11, wherein the bearing assembly includes a first bracket, a spherical bearing assembly having male and female portions having complementary male and female surfaces, a pair of second brackets and a pin, the spherical bearing being disposed between the second brackets, and the first bracket being mounted on the spherical bearing, the second brackets and the spherical bearing have holes therein for the passage therethrough of the pin.

13. A lift assembly as claimed in claim 1, wherein the link means includes a plurality of elongated flexible members, each having an inner end and an outer end, said elongated flexible members being connected at the inner ends thereof to locations adjacent upper ends of the posts, said elongated flexible members having connection means at the outer ends for connecting to the container.

14. A lift assembly as claimed in claim 2, further including a cross strut, having two ends, which is positioned transversely between the first and second ends of the lift assembly, said cross strut being connected adjacent the outer ends of the horizontal longitudinal members.

15. A lift assembly as claimed in claim 14, wherein the link means further includes at least two elongated flexible members each having an inner end and an outer end, said elongated flexible members being connected at the inner ends thereof adjacent the ends of the cross strut, said elongated flexible members having connection means at the outer ends for connecting to the container.

16. A lift assembly as claimed in claim 13, wherein the connection means includes a clevis, a flat member and two bolts, the clevis being located adjacent the outer end of each link means and being adapted to receive an upper end of the flat member, the clevis and the upper end of the flat member having mutually alignable holes therein for the passage therethrough one of the bolts, a lower end of the flat member having a hole therein which is alignable with a receptacle in the container for the passage therethrough of the second bolt.

17. A lift assembly as claimed in claim 15, wherein the connection means includes a clevis, a flat member and two bolts, the clevis being located adjacent the outer end of each link means and being adapted to receive an upper end of the flat member, the clevis and the upper end of the flat member having mutually alignable holes therein for the passage therethrough of one of the bolts, a lower end of the flat member having a hole therein which is alignable with a receptacle in the container for the passage therethrough of the second bolt.

18. A lift assembly as claimed in claim 3, further including weight monitoring means, cooperating with the vertical post, for monitoring the load carried by the vertical post.

19. A lift assembly as claimed in claim 18, wherein (a) the lift means includes a fluid actuator; and (b) the weight monitorinq means includes a pressure transducer, exposed to fluid pressure within the actuator, and means for translating the output of the transducer into a total weight for the container.

20. A lift assembly as claimed in claim 4, wherein the connection means are quick release connection means and include first and second portions and a pin, said portions having holes therein adapted to be mutually aligned so that the pin can pass through the holes in the portions in a horizontal manner to provide a horizontal axis of rotation between adjacent sub-assemblies.

21. A lift assembly as claimed in claim 1, further including means for locating the container relative to the lift assembly.

22. A lift assembly as claimed in claim 21, wherein the means for locating the container relative to the lift assembly includes extensible means adapted to extend inwardly from opposite sides of the assembly to contact the container, whereby the container serves to reduce sway of the lift assembly.

23. A lift assembly as claimed in claim 3, further including means for locating the container relative to the lift assembly, which means includes a locating member having an eccentric cam surface and being journalled for rotation relative to the vertical post, so that the locating member can move between an inactive position and an active position whereby the cam surface contacts the container to prevent relative movement between the container and the lift assembly.

* * * * *